US005224993A

United States Patent [19]

Takahashi et al.

[11] Patent Number: 5,224,993

[45] Date of Patent: Jul. 6, 1993

[54] SIZING AGENT FOR PAPER

[75] Inventors: Yoshio Takahashi; Shigeto Hatanaka, both of Kanagawa, Japan

[73] Assignee: Mitsubishi Oil Co., Ltd., Tokyo, Japan

[21] Appl. No.: 881,631

[22] Filed: May 12, 1992

[30] Foreign Application Priority Data

May 16, 1991 [JP] Japan ..... 3-141132

[51] Int. Cl.[5] ..... C09K 3/00; C09D 7/12

[52] U.S. Cl. ..... 196/287.2; 106/218; 106/243; 530/214; 530/221; 548/546; 162/158; 162/179; 162/180

[58] Field of Search ..... 530/214, 221; 548/546; 106/218, 243, 287.2; 162/158, 179, 180

[56] References Cited

U.S. PATENT DOCUMENTS 3,993,640 11/1976 Pickard et al. ..... 162/158
3,996,240 12/1976 Cullen et al. ..... 548/546
4,687,519 8/1987 Trzasko et al. ..... 106/213

FOREIGN PATENT DOCUMENTS 2040696 2/1971 Fed. Rep. of Germany ..... 548/546
2255414 7/1975 France .
1373411 11/1974 United Kingdom ..... 548/546

*Primary Examiner*—David Brunsman
*Attorney, Agent, or Firm*—Sughrue, Mion, Zinn, Macpeak & Seas

[57] ABSTRACT

The present invention relates to a sizing agent which exerts excellent sizing efficiency even under severe conditions, namely, at an elevated temperature in the papermaking step, or at high conditions with a limited aluminum sulfate addition.

The sizing agent for paper of the present invention is derived from i) dehydration condensation of an alkenylsuccinic anhydride and an organic carboxylic acid with a polyalkylene polyamine and ii) saponification of the remaining carboxyl groups with alkali following the dehydration condensation. More particularly, the present invention relates to a water-soluble sizing agent which is obtained by mixing an alkenylsuccinic anhydride with 1 to 20 times by molar equivalent, based on said alkenylsuccinic anhydride, as much as an organic carboxylic acid, adding 0.1 to 2.0 times by molar equivalent, based on said alkenylsuccinic anhydride, as much as a polyalkylene polyamine thereto so as to perform dehydration condensation. An then, to make the reacted material soluble to water, the remaining carboxyl groups are saponified with an alkali in an amount almost corresponding to the saponification equivalent.

2 Claims, No Drawings

SIZING AGENT FOR PAPER

FIELD OF THE INVENTION

This invention relates to a sizing agent for paper, which is derived from i) dehydration condensation of an alkenylsuccinic anhydride and an organic carboxylic acid with a polyalkylene polyamine and ii) saponification of the remaining carboxyl groups with alkali following the dehydration condensation. This sizing agent shows excellent sizing efficiency even under severe conditions, for example, at an elevated paper-making temperature or at high pH conditions with less addition of aluminum sulfate.

BACKGROUND OF THE INVENTION

Saponified rosin sizing agents have been employed for a long time in a so-called acidic paper-making method wherein aluminum sulfate is used. In recent years, however, regulation on environment has been tightened and thus water is repeatedly circulated in a paper making system. As a result, the temperature of the water is elevated, which seriously deteriorates the sizing efficiency of a sizing agent.

Furthermore, it is known that sizing efficiency is deteriorated under almost neutral conditions due to a decrease in the amount of aluminum sulfate.

When water temperature is elevated or only less aluminum sulfate is added in a paper-making step, as described above, it is preferable to use emulsion-type sizing agents which are superior in sizing efficiency to saponified rosin sizing agents. However these emulsion-type sizing agents have some disadvantages. Namely, they contain emulsifiers which make them highly foamable. In addition, an emulsion is broken due to a mechanical shear force and, as a result, scales and pitch are formed in pipes, tanks and paper machines. When conventional sizing agents are to be substituted with the above-mentioned emulsion-type rosin sizing agents, furthermore, it is needed to alter the equipment including a sizing agent-addition unit, which requires great expense.

On the other hand, JP-B-56-18716 discloses an improved saponified rosin sizing agent which is obtained by subjecting an addition reaction product of rosin with an $\alpha,\beta$-unsaturated acid by using a polyalkylene polyamine and saponifying a mixture of the reaction product thus obtained with rosin by using an alkali (the term "JP-B" as used herein means an "examined Japanese patent publication"). However this sizing agent cannot achieve satisfactory sizing efficiency.

SUMMARY OF THE INVENTION

It is an object of the present invention to provide a saponified sizing agent which is free from any of the above-mentioned disadvantages of conventional saponified rosin sizing agents or emulsion-type rosin sizing agents, capable of exerting satisfactory sizing effects even under severe conditions (for example, at an elevated temperature, in the presence of only a limited amount of aluminum sulfate) and has excellent handling characteristics comparable to those of conventional sizing agents.

The present inventors have conducted extensive studies in order to achieve the above-mentioned object. As a result, they have provided a saponified sizing agent, which is derived from i) dehydration condensation of an alkenylsuccinic anhydride and an organic carboxylic acid with a polyalkylene polyamine and ii) saponification of the remaining carboxyl groups with alkali following the dehydration condensation. The present inventors have found that the resulting sizing agent exerts excellent sizing efficiency over a wide pH range, from acidic to almost neutral region, even at an elevated temperature or in the presence of only a limited amount of aluminum sulfate, thus completing the present invention.

DETAILED DESCRIPTION OF THE INVENTION

Now the present invention will be described in detail. The present invention relates to a water-soluble sizing agent which is obtained by mixing an alkenylsuccinic anhydride with 1 to 20 times by molar equivalent, based on said alkenylsuccinic anhydride, of an organic carboxylic acid, adding 0.1 to 2.0 times by molar equivalent, based on said alkenylsuccinic anhydride, of a polyalkylene polyamine thereto so as to perform dehydration condensation. And then, to make the reacted material soluble to water, the remaining carboxyl groups are saponified with an alkali in an amount almost corresponding to the saponification equivalent. As the alkenylsuccinic anhydride, those obtained by reacting a monoolefin having 6 to 20 carbon atoms with maleic anhydride may be used. Regarding the structure of the olefin, either straight-chain $\alpha$-olefins, straight-chain internal olefins or branched olefins may be used. The organic carboxylic acid may be selected from among alkenylsuccinic acids, which are obtained by adding the equimolar amount of water to the above-mentioned alkenylsuccinic anhydrides, rosin, fatty acids, maleic rosin, derivatives thereof and mixtures thereof. The polyalkylene polyamine may be selected from among those represented by a structural formula:

$$H_2N-(CH_2-CH_2-NH)_n-H$$

wherein n is an integer of from 1 to 5; such as ethylenediamine, diethylenetriamine, triethylenetetramine, tetraethylenepentamine and pentaethylenehexamine.

The above-mentioned alkenylsuccinic anhydride is a compound represented by, for example, the following structural formula:

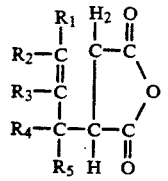

wherein $R_1$ to $R_5$ represent each a hydrogen atom or an alkyl group. The carbon number of $R_1+R_2+R_3+R_4+R_5+R_6$ ranges from 3 to 7.

The above-mentioned organic carboxylic acid is represented by, for example, the following structural formula:

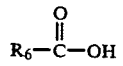

wherein $R_6$ is an organic group consisting of, for example, carbon, hydrogen and oxygen atoms.

The material, obtained through dehydration condensation of an alkenylsuccinic anhydride and an organic carboxylic acid with a polyalkylene polyamine, contains the compounds represented, for example, by the following formulae:

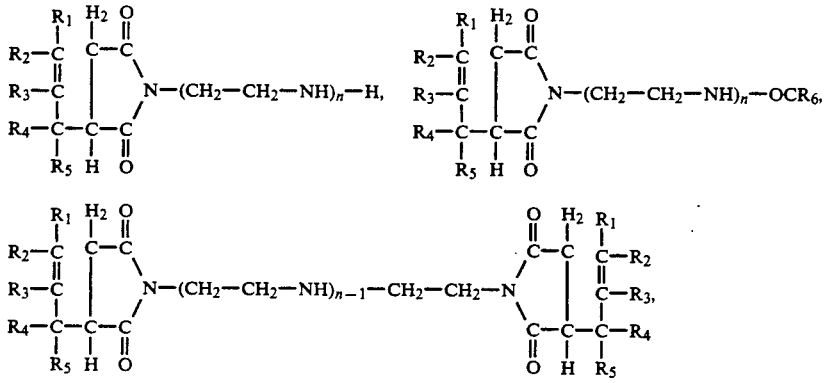

$R_6CONH-(CH_2-CH_2-N)_n-OCR_6$ and,
$R_6CONH-(CH_2-CH_2-NH)_n-H$.

To further illustrate the present invention in greater detail, the following non-limiting Examples will be given.

EXAMPLE 1

To 1,000 g of a propylene oligomer of an average carbon atom number of 12 (carbon atom number distribution: $C_{10}$ 0.5%; $C_{11}$ 12.9%; $C_{12}$ 70.4%; $C_{13}$ 14.3%; $C_{14}$ 1.9%), 583 g of maleic anhydride was added. The obtained mixture was reacted in an autoclave at 215 ° C. for 7 hours without using any catalyst. After removing the unreacted matters from the reaction mixture by distilling under reduced pressure, 1,150 g of an alkenylsuccinic anhydride (saponification value: 427) was obtained.

34 g of water was added to 500 g of the obtained alkenylsuccinic anhydride and the mixture was heated to 100 20 C. under stirring for 1 hour. Thus an alkenylsuccinic acid (ring-opened acid) was prepared.

To 50 g of the above-mentioned alkenylsuccinic anhydride and 220 g of the above-mentioned alkenylsuccinic acid, 100.g of toluene was added and the mixture was heated. Then 20 g of triethylenetetramine was slowly added thereto within 20 minutes, while maintaining the temperature of the mixture to 100 ° C. After the completion of the addition, the mixture was reacted under refluxing the toluene for 1 hour. Then the mixture was heated to 210 ° C. and the toluene was distilled off together with 14.0 g of reaction water. The resin thus obtained had a saponification value of 281.

This resin was saponified with caustic soda of the saponification equivalent so as to give a 30% aqueous solution of a sizing agent.

EXAMPLE 2

The procedure of the above Example 1 was repeated except that the alkenylsuccinic acid (ring-opened acid) was replaced by rosin. That is to say, 50 g of the alkenylsuccinic anhydride prepared in the above Example 1, 220 g of gum rosin (saponification value: 172) and 20 g of triethylenetetramine were subjected to dehydration condensation to thereby give a resin. The resin thus obtained had a saponification value of 158 and 4.6 g of water was formed during the reaction.

This resin was saponified with caustic soda of the saponification equivalent so as to give a 30% aqueous solution of a sizing agent.

EXAMPLE 3

The procedure of the above Example 1 was repeated except that the triethylenetetramine was replaced by tetraethylenepentamine. That is to say, 50 g of the alkenylsuccinic anhydride prepared in the above Example 1, 220 g of the alkenylsuccinic acid (ring-opened acid) and 25.9 g of tetraethylenepentamine were subjected to dehydration condensation to thereby give a resin. The resin thus obtained had a saponification value of 294 and 12.5 g of water was formed during the reaction.

This resin was saponified with caustic soda of the saponification equivalent so as to give a 30% aqueous solution of a sizing agent.

EXAMPLE 4

To 50 g of a marketed neutral alkenylsuccinic anhydride for sizing (Fibran 71 (trademark), a product of National Starch Co.), produced by reacting a straight-chain internal olefin having 16 carbon atoms with maleic anhydride, and 450 g of gum rosin (saponification value: 172), 200 g of toluene was added. Next, 20 g of triethylenetetramine was slowly added within 20 minutes while maintaining the temperature of the mixture at 100 ° C. After the completion of the addition, the mixture was reacted under refluxing the toluene for 1 hour. Then the mixture was heated to 210 ° C. and the toluene was distilled off together with 7.5 of reaction water. The resin thus obtained had a saponification value of 156.

This resin was saponified with caustic soda in an amount 1.05 times by saponification equivalent so as to give a 30% aqueous solution of a sizing agent.

EXAMPLE 5

To 1,000 g of a propylene oligomer of an average carbon atom number of 9.2 (carbon atom number distribution: $C_8$ 3.2%; $C_9$ 74.3%; $C_{10}$ 19.7%; $C_{11}$ 2.8%), 432 g of maleic anhydride was added. The obtained mixture was reacted in an autoclave at 215 ° C. for 5 hours without using any catalyst. After removing the unreacted matters from the reaction mixture by distilling under reduced pressure, 980 g of an alkenylsuccinic anhydride (saponification value: 503) was obtained.

To 40 g of the obtained alkenylsuccinic anhydride, 150 g of gum rosin (saponification value: 172), 70 g of oleic acid and 100 g of toluene were added. 25.9 g of tetraethylene-pentamine was then slowly added thereto within 20 minutes while maintaining the temperature of the mixture at 100 ° C. After the completion of the addition, the mixture was reacted under refluxing the toluene for 1 hour. Then the mixture was heated to 210 ° C. and the toluene was distilled off together with 5.3 g of reaction water. The resin thus obtained had a saponification value of 155.

This condensed resin was saponified with caustic soda of the saponification equivalent so as to give a 10% aqueous solution of a sizing agent.

COMPARATIVE EXAMPLE 1 AND 2

A marketed saponified rosin sizing agent (RF Size 880L (trademark), a product of Misawa Ceramic Chemical Co., mainly comprising potassium-saponified reinforced rosin) and a marketed emulsion-type rosin sizing agent (OT-500J (trademark), a product of DIC-Hercules Chemical Co., mainly comprising emulsified reinforced rosin) were used.

COMPARATIVE EXAMPLE 3

In this Comparative Example 3, a sizing agent was produced in accordance with JP-B-56-18716. Namely, 100 g of toluene was added to 100 g of 15% maleic gum rosin (saponification value: 308) and 100 g of gum rosin (saponification value: 172) and the obtained mixture was heated. Then 14.3 g of triethylenetetramine was slowly added thereto within 20 minutes while maintaining the temperature of the mixture at 100 ° C. After the completion of the addition, the mixture was reacted under refluxing the toluene. Then the mixture was heated to 210 ° C. and the toluene was distilled off together with 3.2 g of reaction water. The resin thus obtained had a saponification value of 148. This resin was saponified with caustic soda of the saponification equivalent. Thus a 30% aqueous solution of a sizing agent was obtained.

By using hand-made paper, the sizing effects of the sizing agents of the present invention obtained in the above Examples 1 to 5 were compared with those of the comparative sizing agents of the above Comparative Examples 1 to 3. A pulp (LBKP) was beaten until the CSF reached 450 ml and diluted with tap water so as to give a 2% slurry. Next, 1%, based on the content of solid matters in the pulp, of aluminum sulfate was added thereto and then the pH value of the pulp slurry was adjusted to 5.0 or 6.0 with sulfuric acid or caustic soda. Then 0.3% or 0.5%, based on the content of solid matters in the pulp, of a sizing agent was added and a hand-made paper sheet weighing 60 g/m$^2$ was produced with a Tappi Standard Sheet Machine.

In order to examine the influences of temperature at the paper-making step, the performances of the sizing agents were compared with each other at a temperature of the pulp slurry and the water used in the paper-making step of 30 ° C. and 50 ° C. The paper sheets thus obtained were pressed, dried with a rotary drier at 105 ° C. for 1 minute and then subjected to moisture-conditioning at 20 ° C. under a relative humidity (RH) of 60% for 1 day. The sizing degrees of the hand-made paper samples thus obtained were determined by the Stöckigt method (JISP-8122). Table 1 shows the results.

TABLE 1

Comparison of Sizing Efficiency
Paper-making conditions

| pH | 50.0 | | | | 6.0 | | | |
|---|---|---|---|---|---|---|---|---|
| Temperature (°C.) | 30 | | 50 | | 30 | | 50 | |
| Sizing agent (%) | 0.3 | 0.5 | 0.3 | 0.5 | 0.3 | 0.5 | 0.3 | 0.5 |
| Sizing degree (sec.) | | | | | | | | |
| Example 1 | 17 | 30 | 15 | 25 | 15 | 27 | 11 | 24 |
| Example 2 | 15 | 28 | 11 | 23 | 15 | 25 | 9 | 18 |
| Example 3 | 16 | 31 | 14 | 24 | 12 | 24 | 10 | 21 |
| Example 4 | 14 | 25 | 10 | 24 | 14 | 23 | 8 | 15 |
| Example 5 | 15 | 26 | 11 | 21 | 10 | 21 | 9 | 16 |
| Comp. Example 1 | 10 | 21 | 4 | 12 | 1 | 3 | 0 | 1 |
| Comp. Example 2 | 15 | 27 | 10 | 19 | 5 | 14 | 3 | 8 |
| Comp. Example 3 | 12 | 23 | 7 | 15 | 7 | 18 | 5 | 13 |

In the above Examples 1 to 5, the aluminum sulfate concentration was varied from 1% to 0.5% and the sizing efficiency of the sizing agents at pH 6.0 and 50° C. was compared with each other. As Table 2 shows, the sizing efficiency of the present invention was achieved in each case.

TABLE 2

Comparison of Sizing Efficiency

| Paper-making conditions | | |
|---|---|---|
| pH | 6.0 | |
| Temperature (°C.) | 50 | |
| Aluminum sulfate (%) | 0.5 | |
| Sizing agent (%) | 0.3 | 0.5 |
| Sizing degree (sec.): | | |
| Example 1 | 10 | 23 |
| Example 2 | 9 | 17 |
| Example 3 | 7 | 18 |
| Example 4 | 5 | 12 |
| Example 5 | 8 | 14 |
| Comp. Example 1 | 0 | 0 |
| Comp. Example 2 | 1 | 3 |
| Comp. Example 3 | 4 | 11 |

EXAMPLE 6

The procedure of the above Example 1 was repeated except that the alkenylsuccinic anhydride (ring-opened acid) was replaced by oleic acid. Namely, 50 g of the alkenylsuccinic anhydride prepared in the above Example 1, 200 g of oleic acid and 15 g of triethylenetetramine were subjected to dehydration condensation to thereby give a resin. The obtained resin had a saponification value of 140 and 3.5 g of water was formed during the reaction. This resin was saponified with caustic soda of the saponification equivalent so as to give a 10% aqueous solution of a sizing agent.

As a result, the sizing efficiency of the present invention was achieved.

Mechanical Stability Test

The mechanical stabilities of the sizing agents obtained in the above Examples 1 to 6 and Comparative Example 1 to 3 were determined in accordance with the method specified in JISK-6387. That is to say, 50 g of each sizing agent diluted to 10% was fed into a device (Maron testing machine) shown in JISK-6387 and tested under a load of 10 kg for 30 minutes. Then the formation of sludge was evaluated with the naked eye. Table 3 shows the results. The formation of sludge was observed in the case of the emulsiontype rosin sizing agent of Comparative Example 2.

TABLE 3

| Result of Mechanical Stability Test | |
|---|---|
| | Formation of sludge |
| Example 1 | none |
| Example 2 | none |
| Example 3 | none |
| Example 4 | none |
| Example 5 | none |
| Example 6 | none |
| Comp. Example 1 | none |
| Comp. Example 2 | present |
| Comp. Example 3 | none |

As the above Tables 1 to 3 clearly show, each sizing agent of the present invention is excellent in sizing efficiency even in a system of an extremely high temperature (50 ° C.) at the paper-making step or in a system of a low aluminum sulfate concentration. Further, it is also excellent in mechanical strength.

While the invention has been described in detail and with reference to specific embodiments thereof, it will be apparent to one skilled in the art that various changes and modifications can be made therein without departing from the spirit and scope thereof.

What is claimed is:

1. A sizing agent for paper which is derived from i) dehydration condensation of an alkenylsuccinic anhydride and an organic carboxylic acid with a polyalkylene polyamine and ii) saponification of the remaining carboxyl groups with alkali following the dehydration condensation.

2. A sizing agent for paper as claimed in claim 1, wherein said organic carboxylic acid is selected from among alkenylsuccinic acids, rosin, maleic rosin, fatty acids, derivatives thereof and mixtures thereof.

* * * * *